US011906198B2

(12) United States Patent
Hiroishi et al.

(10) Patent No.: US 11,906,198 B2
(45) Date of Patent: Feb. 20, 2024

(54) AIR-CONDITIONING SYSTEM

(71) Applicant: FH ALLIANCE INC., Kasugai (JP)

(72) Inventors: Kazuro Hiroishi, Kasugai (JP); Hiromi Sugiyama, Kamo-gun (JP)

(73) Assignee: FH ALLIANCE INC., Kasugai (JP)

( * ) Notice: Subject to any disclaimer, the term of this patent is extended or adjusted under 35 U.S.C. 154(b) by 0 days.

(21) Appl. No.: 17/879,671

(22) Filed: Aug. 2, 2022

(65) Prior Publication Data

US 2022/0373198 A1 Nov. 24, 2022

Related U.S. Application Data

(63) Continuation of application No. 16/943,339, filed on Jul. 30, 2020, now Pat. No. 11,441,796, which is a (Continued)

(51) Int. Cl.
*F24F 3/04* (2006.01)
*F24F 3/00* (2006.01)
(Continued)

(52) U.S. Cl.
CPC ..... *F24F 3/0444* (2013.01); *F24F 3/044* (2013.01); *F24F 3/0527* (2013.01); *F24F 5/00* (2013.01); *F24F 2221/54* (2013.01)

(58) Field of Classification Search
CPC ..... F24F 3/044; F24F 3/0444; F24F 3/0527; F24F 5/00; F24F 2221/54
See application file for complete search history.

(56) References Cited

U.S. PATENT DOCUMENTS 3,169,382 A 2/1965 Brown
10,974,569 B2 4/2021 Hiroshi
(Continued)

FOREIGN PATENT DOCUMENTS

CN 1391072 A 1/2003
JP 10-78244 A 3/1998
(Continued)

OTHER PUBLICATIONS

International Search Report for International Application No. PCT/JP2016/081263 dated Dec. 27, 2016.
(Continued)

*Primary Examiner* — Marc E Norman
(74) *Attorney, Agent, or Firm* — Kratz, Quintos & Hanson, LLP

(57) ABSTRACT

In a construction method of an air conditioning system, the respective rooms are provided with air intake sections 9*a* to 9*d*, 18*a* to 18*d* which spout air sent from blowers 40*a* to 40*d*, 41*a* to 41*d*, an exhaust section 52 which forms discharged air current directed from the respective rooms toward the return compartment is provided between the respective rooms and the return compartment, and the plurality of blowers 40*a* to 40*d*, 41*a* to 41*d* and at least one air conditioner are disposed in the return compartment. Air discharged from the plurality of rooms in the building 1 by the air conditioner 30*b* operated by the return compartment is adjusted in temperature and moisture in the return compartment, and wind is sent into the plurality of rooms in the building 1 by the blowers 40*a* to 40*d*, 41*a* to 41*d*, and air conditioning in the building 1 can be performed.

5 Claims, 8 Drawing Sheets

61: building
66: corridor
68a, 68b, 68c, 68d, 68e, 68f: spout grill
30b: air conditioner
33b: spout air current of air conditioner
90: exhaust section

Related U.S. Application Data continuation of application No. 16/312,076, filed as application No. PCT/JP2016/081263 on Oct. 21, 2016, now Pat. No. 11,098,908.

(51) Int. Cl.

| | |
|---|---|
| ***F24F 3/044*** | (2006.01) |
| ***F24F 3/052*** | (2006.01) |
| ***F24F 5/00*** | (2006.01) |

(56) References Cited

U.S. PATENT DOCUMENTS

| | | | | |
|---|---|---|---|---|
| 11,098,908 | B2 * | 8/2021 | Hiroishi | F24F 3/044 |
| 11,441,796 | B2 * | 9/2022 | Hiroishi | F24F 3/0527 |
| 2022/0404058 | A1 * | 12/2022 | Hiroishi | F24F 11/58 |

FOREIGN PATENT DOCUMENTS

| | | | |
|---|---|---|---|
| JP | H10-160198 | A | 6/1998 |
| JP | H11-257684 | A | 9/1999 |
| JP | 2006-258358 | A | 9/2006 |
| JP | 2009-250442 | A | 10/2009 |
| JP | 2010-117111 | A | 5/2010 |
| JP | 2012-057880 | A | 3/2012 |
| JP | 2015-215107 | A | 12/2015 |
| JP | 2016-33448 | A | 3/2016 |
| WO | 2015/034079 | A1 | 3/2015 |

OTHER PUBLICATIONS

Office Action of Japanese Patent Application No. 2018-546120: Decision of Refusal dated Jun. 29, 2020 (2 sheets, 3 sheets translation, 5 sheets total).

Office Action of Chinese Patent Application No. 201680086887.8 dated May 29, 2020 (12 sheets, 20 sheets translation, 32 sheets total).

Lu, Yaoqing; "Handbook for Practical Air-Conditioning Design for Heat Transfer"; 2nd Edition; pp. 1821-1854, 2415-2424 (42 pages).

Office Action of corresponding Japanese Patent Application No. 2020-168798: Notice of Reasons for Refusal dated Sep. 7, 2021 (5 sheets, 6 sheets translation, 11 sheets total).

M. Gestwick, et al.; "HVAC Right-Sizing Part 1: Calculating Loads"; Apr. 28, 2011; U.S. Department of Energy (64 sheets).

* cited by examiner

[Fig. 1]
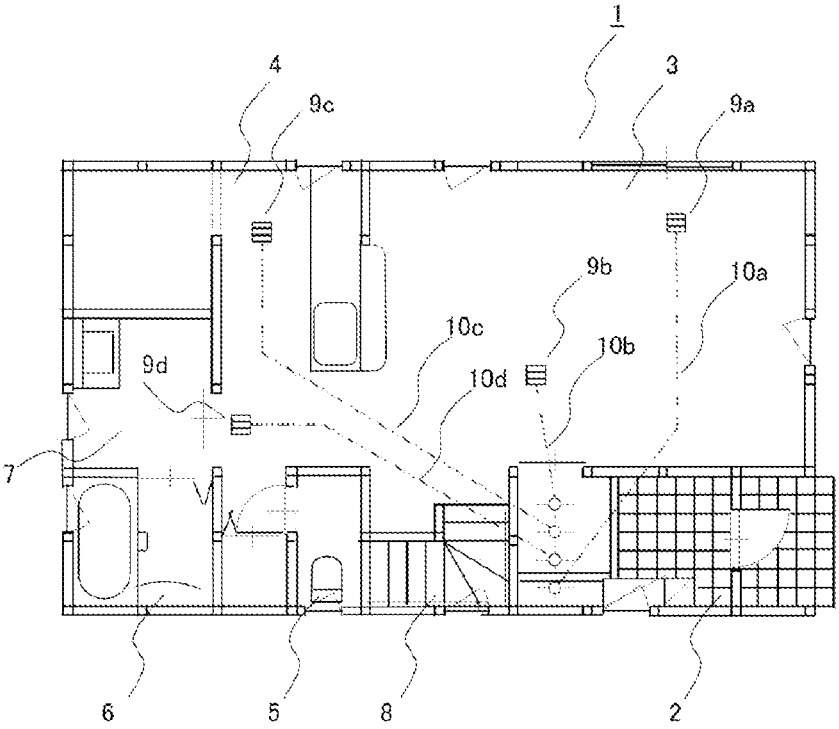
1: building
9a, 9b, 9c, 9d: spout grill

[Fig. 2]
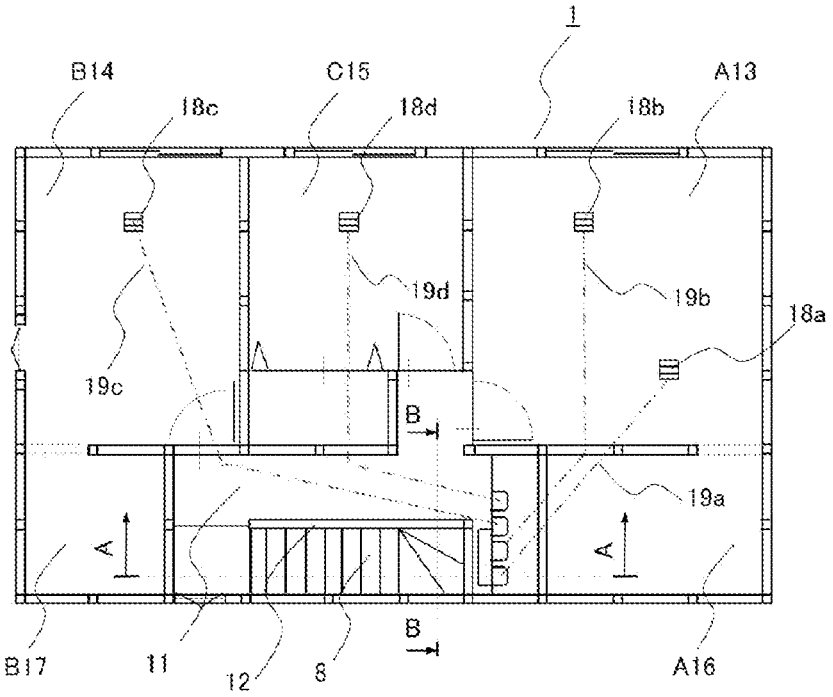
1: building
12: stair case
18a, 18b, 18c, 18d: spout grill

[Fig. 3]
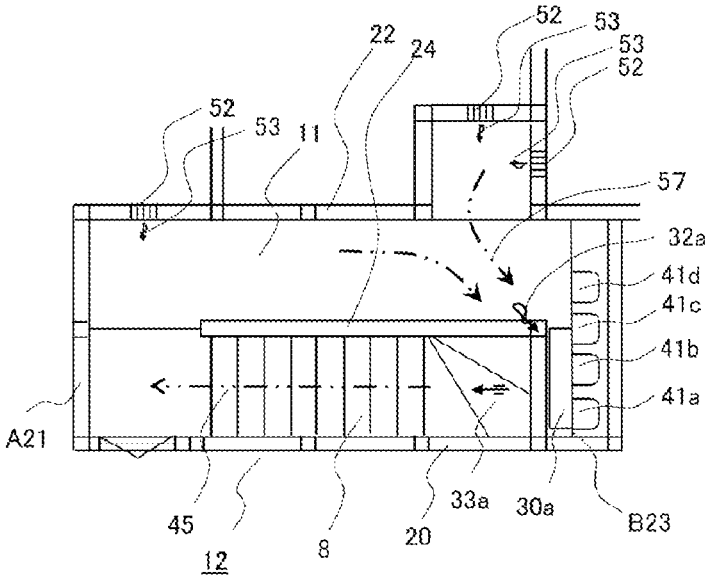
30a: air conditioner
33a: spout air current of air conditioner
41a, 41b, 41c, 41d: second floor blower
52: exhaust section

[Fig. 4]
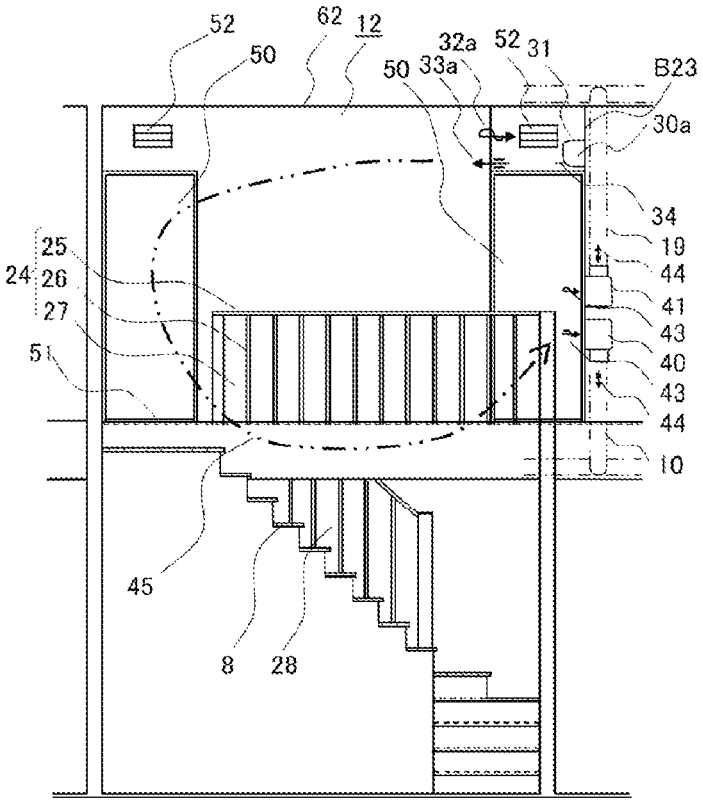
30a: air conditioner
33a: spout air current of air conditioner
52: exhaust section

[Fig. 5]
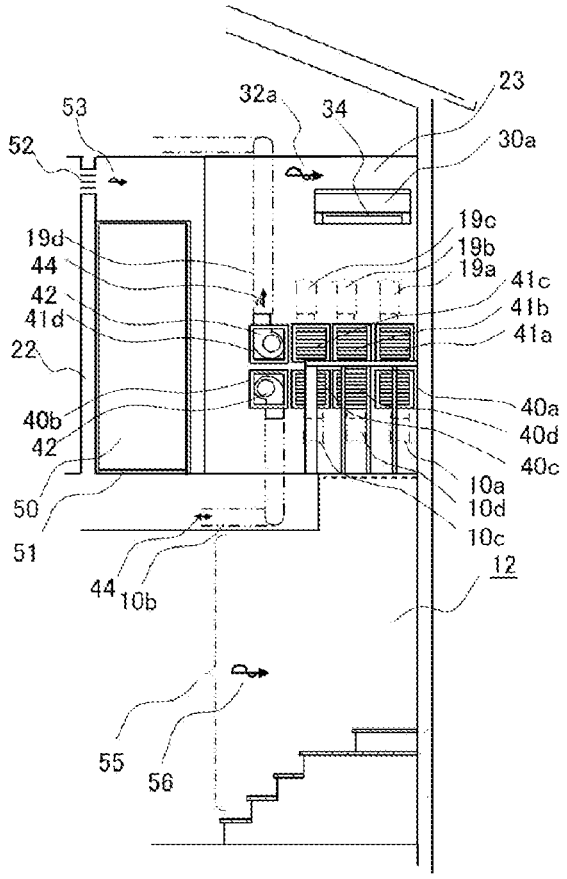
30a: air conditioner
40a, 40b, 40c, 40d: first floor blower
52: exhaust section
55: discharge section

[Fig. 6]
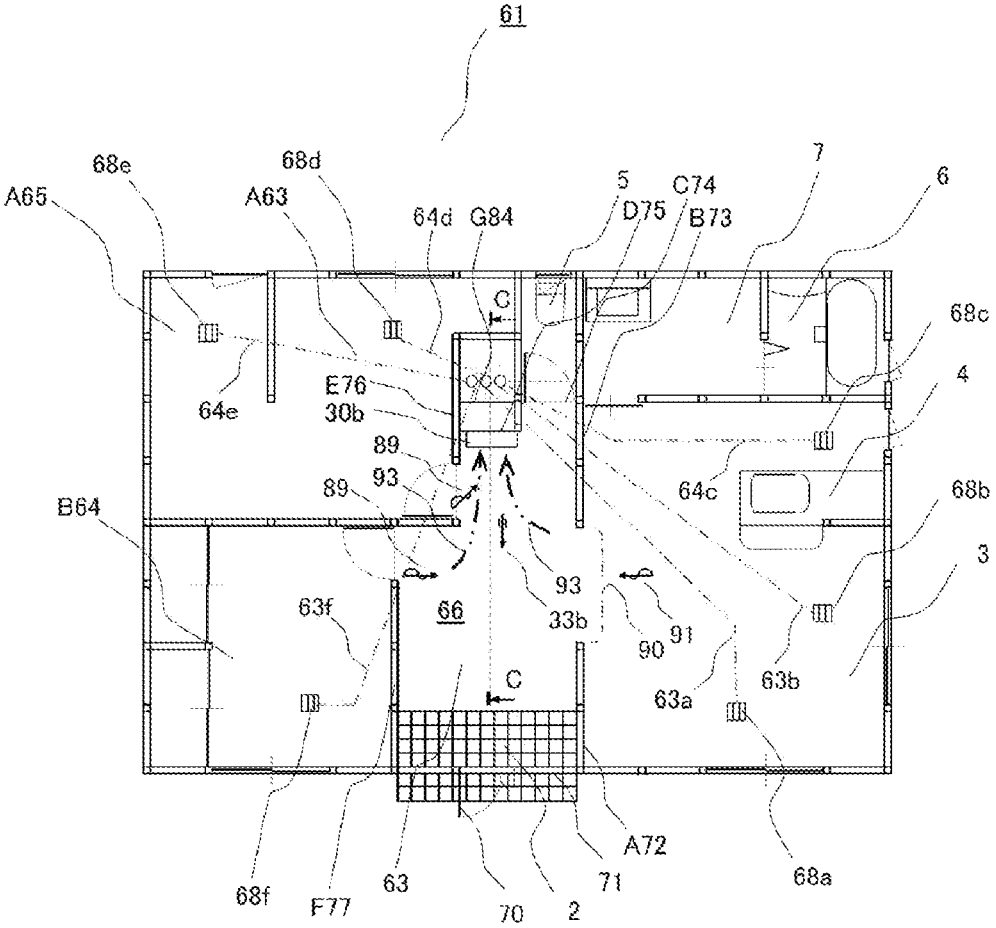
61: building
66: corridor
68a, 68b, 68c, 68d, 68e, 68f: spout grill
30b: air conditioner
33b: spout air current of air conditioner
90: exhaust section

[Fig. 7]
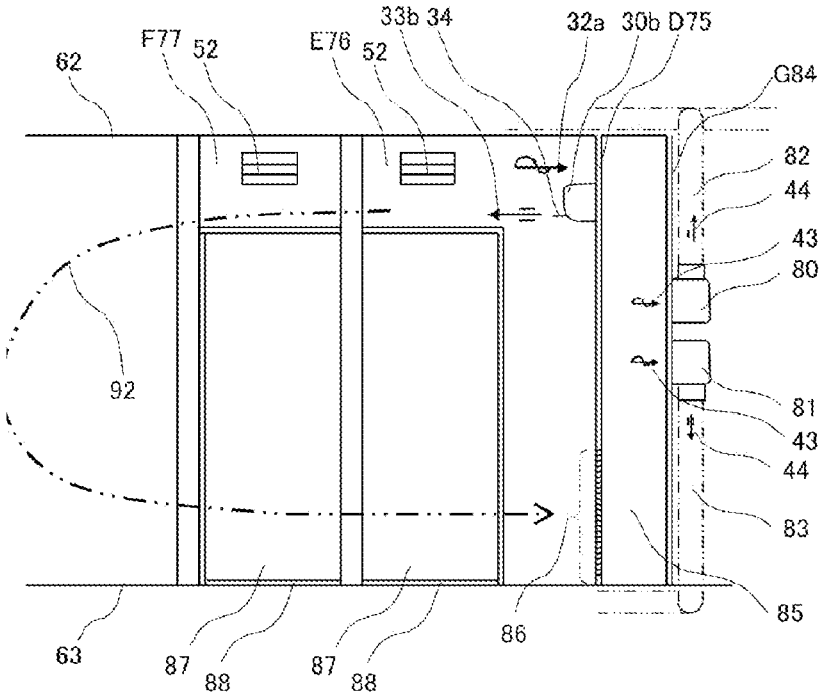
30b: air conditioner
33b: spout air current of air conditioner
52: exhaust section
80 : ceiling blower
81 : underfloor blower

[Fig. 8]
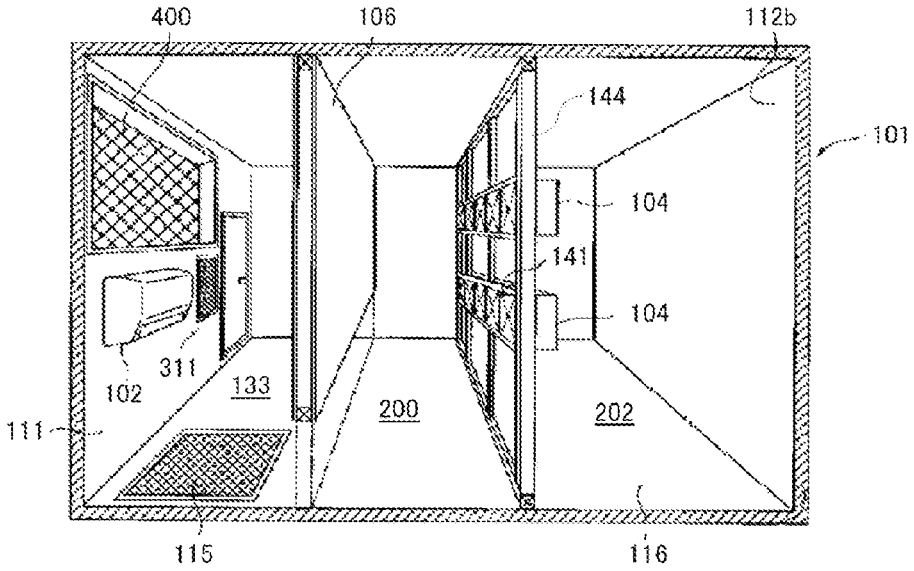

AIR-CONDITIONING SYSTEM

TECHNICAL FIELD

The present invention relates to a construction method and a design method of an air conditioning system which conditions air in a plurality of rooms in a building by one air conditioner and a plurality of blowers.

BACKGROUND TECHNIQUE

There is a conventionally known air conditioning system of this kind in which an air conditioner chamber is provided in a building, air which is sucked into the air conditioner chamber is adjusted in temperature by an, and the air is sent to a plurality of rooms by the blower (see patent document 1 for example).

The conventional air conditioning system will be described hereinafter with reference to FIG. 8.

As shown in FIG. 8, an air conditioner chamber 101 is placed in an attic of a building, and a hanging wall 106 which is suspended and an opening between the hanging wall 106 and a floor surface 116 is provided in this air conditioner chamber 101. According to this, the air conditioner chamber 101 is divided into two chambers, i.e., a mixing section 133 and a dispersing chamber 200.

A one side wall 111 of the mixing section 133 which is one of the chambers of the air conditioner chamber 101 is provided with an attic air suction port 400 as an outside air suction port and an outside air introduction port 311, and the floor surface 116 is provided with a louver 115 as a ventilator. An air conditioner 102 is placed on the one side wall 111. The louver 115 is in communication with a space in a house for again returning, into the air conditioner chamber 101, air which is sent into the house from the air conditioner chamber 101.

The dispersing chamber 200 which is the other chamber of the air conditioner chamber 101 is provided with an air-supply blower mounting wall 144 which is parallel with the hanging wall 106. Air-supply blowers 104 are mounted on the air-supply blower mounting wall 144. A space on a side of the air-supply blower mounting wall 144 opposite from the hanging wall 106, i.e., a space between the air-supply blower mounting wall 144 and a wall surface 112*b* is a piping space 202 of air-supply ducts (not shown) which are connected to the air-supply blowers 104 and placed in the respective rooms of the house. Through holes (not shown) as many as the rooms which are to be air-conditioned are formed in the wall surface 112*b* and the floor surface 116 of the air conditioner chamber 101. The air-supply ducts pass through the through holes.

The air-supply blowers 104 are driven by a DC motor. Air in the air conditioner chamber 101 is sucked from intake ports 141 which are fan intake ports of the air-supply blowers 104, and the air is sent to the plurality of rooms of the house. The air is circulated between the air conditioner chamber 101 and the rooms. If the air conditioner 102 is driven, air from the air conditioner flows out into the mixing section 133. If the air-supply blowers 104 are driven, air from the attic flows out from the attic air suction port 400 into the air conditioner chamber 101, and outside air flows out from the outside air introduction port 311 into the air conditioner chamber 101. Air is conditioned in the plurality of rooms of the house in this manner using the one air conditioner 102 and the plurality of air-supply blowers 104.

PRIOR ART DOCUMENT

Patent Document

[Patent Document 1]
Japanese Patent Application Laid-open No. 2012-57880

SUMMARY OF THE INVENTION

Problem to be Solved by the Invention

According to such a conventional air conditioning system, in order to place the air conditioner, it is necessary to provide the air conditioner chamber as a chamber for exclusive use. Further, in order to mix intake air, i.e., intake air current into the air conditioner chamber and spout air, i.e., spout air current of the air conditioner with each other, it is necessary to provide the mixing section in the air conditioner chamber. Further, (as described in paragraph 0046 of the prior patent document also) positions of the air conditioner, an exhaust port and an air supply port are too close, and in order to prevent short circuit which is a phenomenon where air is adversely circulated in a narrow scope, it is necessary to separate the positions of the air conditioner, the exhaust port and the air supply port from each other as far as possible. A certain size of capacitor is necessary for the air conditioner chamber, and it is not easy to construct the air conditioner chamber.

The present invention has been accomplished to solve the conventional problem, and it is an object of the invention to provide a construction method and a design method of an air conditioning system in which a chamber for placing an air conditioner therein is unnecessary, it is easy to separate the positions of the air conditioner, the exhaust port and the air supply port from each other, and spout air current from the air conditioner is less prone to be short circuited.

Means for Solving the Problem

To achieve the above object, in a construction method of an air conditioning system of the present invention, a return compartment which is adjacent to a plurality of rooms is formed in a building, the respective rooms are provided with air intake sections which spout air sent from blowers, an exhaust section which forms exhausted air current directed from the respective rooms toward the return compartment is provided between the respective rooms and the return compartment, and the plurality of blowers and at least one air conditioner are disposed in the return compartment.

According to this means, it is possible to provide an air conditioning system capable of air-conditioning the plurality of rooms by the air conditioner placed in the return compartment, and in which it is unnecessary to provide an air conditioner chamber for exclusive use for placing the air conditioner therein.

According to other means, the return compartment is a stair case or a corridor in the building.

According to this, since a certain size of capacity is secured in the return compartment for constructing the air conditioner, it is possible to provide the air conditioning system in which the air conditioner, the exhaust port and the intake port are separated from each other in the return compartment.

According to another means, a suction port of the blower is provided while avoiding a spout direction of spout air current from the air conditioner.

With this means, it is possible to provide an air conditioning system in which spout air current from the air conditioner is less prone to be short circuited.

According to another means, a suction port of the blower is disposed below a spout port of spout air current from the air conditioner, and a spout direction of the spout air current from the air conditioner is substantially a horizontal direction.

With this means, it is possible to provide an air conditioning system in which spout air current from the air conditioner is less prone to be short circuited.

According to another means, at least one exhaust section is provided above the air conditioner.

With this means, it is possible to provide an air conditioning system in which spout air current from the air conditioner is less prone to be short circuited.

According to another means, a total blast air volume of the plurality of blowers is larger than an air-conditioning air volume of the air conditioner.

With this means, it is possible to provide an air conditioning system in which the air conditioner chamber for exclusive use is unnecessary, and the air conditioner, an exhaust port and an intake port can easily be separated from each other in the return compartment.

To achieve the above object, in a design method of an air conditioning system of the invention, the design method includes an air-conditioning ability determining step of determining air-conditioning ability of the air conditioner by calculation of an air conditioning load concerning the building, a blast air volume determining step of determining a blast air volume sent to the respective rooms from the respective capacity of the rooms, a total blast air volume calculating step of calculating a total blast air volume in which the blast air volumes into the respective rooms determined by the blast air volume determining step are added up, and an air-conditioning air volume determining step of determining an optimal air-conditioning air volume of the air conditioner from the total blast air volume determined by the total blast air volume calculating step, the blowers which send air to the respective rooms are selected from the blast air volume determined by the blast air volume determining step, the air conditioning system further has the air-conditioning ability determined by the air-conditioning ability determining step, and the air conditioner capable of setting an air-conditioning air volume which is equal to or less than the optimal air-conditioning air volume determined by the air-conditioning air volume determining step is selected.

According to this means, it is possible to optimally select the blower and the air conditioner used for the air conditioning system including a plurality of rooms and a return compartment in a building, in which an air intake section which spouts air sent from blowers are provided in the respective rooms, an exhaust section which forms discharged air current directed from the respective rooms toward the return compartment is provided in the respective rooms, the plurality of blowers and at least one air conditioner are provided in the return compartment, the air in the return compartment is guided from the air intake section to the respective rooms, and the air in the respective rooms is guided from the exhaust section to the return compartment.

According to another means, when the air conditioner having the air-conditioning ability determined by the air-conditioning ability determining step cannot set the air-conditioning air volume which is equal to or less than the optimal air-conditioning air volume determined by the air-conditioning air volume determining step, the blower is selected such that a minimum air-conditioning air volume which can be set by the air conditioner becomes equal to or less than 70% of the total blast air volume.

According to this means, in selecting the blower and the air conditioner used for the air conditioning system including a plurality of rooms and a return compartment in a building, an air intake section which spouts air sent from blowers are provided in the respective rooms, an exhaust section which forms discharged air current directed from the respective rooms toward the return compartment is provided in the respective rooms, the plurality of blowers and at least one air conditioner are provided in the return compartment, the air in the return compartment is guided from the air intake section to the respective rooms, and the air in the respective rooms is guided from the exhaust section to the return compartment, when the total blast air volume which is required by the blower since the total volume of especially the respective rooms is small is small, it is possible to optimally design the air-conditioning air volume and the total blast air volume.

According to another means, the blower having air volume adjustment means capable of adjusting an air volume is selected.

With this means, after the air conditioning system is constructed, an air volume is increased or decreased using the air volume adjustment means, thereby adjusting the air-conditioning ability, thereby adjusting in accordance with variation in an air conditioning load of the respective rooms.

Effect of the Invention

According to the present invention, it is possible to provide an air conditioning system having such an effect that it is unnecessary to provide an air conditioner chamber, an air conditioner, an exhaust port and an intake port can easily be placed and these members can easily be constructed.

Further, it is possible to provide an air conditioning system having such an effect that spout air current from an air conditioner is less prone to be short circuited, the spout air current is diffused and mixed, air conditioned air of equal moisture can be supplied to a plurality of rooms, and moisture differences in the respective rooms are small.

BRIEF DESCRIPTION OF THE DRAWINGS

FIG. 1 is a plan view of a first floor of a building showing a configuration of an air conditioning system according to a first embodiment of the present invention;

FIG. 2 is a plan view of a second floor of the building;

FIG. 3 is an enlarged plan view of a stair case portion of the second floor of the building;

FIG. 4 is a sectional view of the stair case portion of the second floor of the building taken along a line A-A;

FIG. 5 is a sectional view of the stair case portion of the second floor of the building taken along a line B-B;

FIG. 6 is a plan view of a building showing a configuration of an air conditioning system according to a second embodiment of the invention;

FIG. 7 is a sectional view of a corridor portion of the building taken along a line C-C; and FIG. 8 is a perspective view showing an air conditioner chamber of a conventional air conditioning system.

MODE FOR CARRYING OUT THE INVENTION

A first aspect of the present invention provides a construction method of an air conditioning system wherein a return compartment which is adjacent to a plurality of rooms is formed in a building, the respective rooms are provided with air intake sections which spout air sent from blowers, an exhaust section which forms exhausted air current directed from the respective rooms toward the return compartment is provided between the respective rooms and the return compartment, and the plurality of blowers and at least one air conditioner are disposed in the return compartment. With this aspect, air discharged from the plurality of rooms in the building is adjusted in moisture in the return compartment by the air conditioner which is operated in the return compartment, and the air is sent to the plurality of rooms in the building, thereby making it possible to condition air in the building.

In a construction method of an air conditioning system according to second and third aspects of the invention, the return compartment is a stair case or a corridor in the building. With these aspects, since it is possible to condition the air in the building in the return compartment, it is unnecessary to provide the air conditioner chamber for exclusive use, and it is possible to secure a certain size of capacity for installing the air conditioner.

According to a construction method of an air conditioning system of a forth aspect of the invention, a suction port of the blower is provided while avoiding a spout direction of spout air current from the air conditioner. Spout air current from the air conditioner is not directly sucked by the blower, short circuit is less prone be generated, and the spout air current can be diffused and mixed in the return compartment.

According to a construction method of an air conditioning system of a fifth aspect of the invention, a suction port of the blower is disposed below a spout port of spout air current from the air conditioner, and a spout direction of the spout air current from the air conditioner is substantially a horizontal direction. Spout air current from the air conditioner is not directly sucked by the blower, short circuit is less prone to be generated, and the spout air current can be diffused and mixed in the return compartment.

According to a construction method of an air conditioning system of a sixth aspect of the invention, at least one exhaust section is provided above the air conditioner. Since air discharged from the building is sucked into the air conditioner, it is possible to control the operation of the air conditioner by detecting a temperature close to a room temperature.

According to a construction method of an air conditioning system of a seventh aspect of the invention, a total blast air volume of the plurality of blowers is larger than an air-conditioning air volume of the air conditioner. Since the air volume more than the air-conditioning air volume of the air conditioner is discharged from and flows into the rooms in the building, short circuited is less prone to be generated, and spout air from the air conditioner and inflow air from the respective rooms can be mixed with each other in the return compartment.

According to a design method of an air conditioning system of an eighth aspect of the invention, the design method includes an air-conditioning ability determining step of determining air-conditioning ability of the air conditioner by calculation of an air conditioning load concerning the building, a blast air volume determining step of determining a blast air volume sent to the respective rooms from the respective capacity of the rooms, a total blast air volume calculating step of calculating a total blast air volume in which the blast air volumes into the respective rooms determined by the blast air volume determining step are added up, and an air-conditioning air volume determining step of determining an optimal air-conditioning air volume of the air conditioner from the total blast air volume determined by the total blast air volume calculating step, the blowers which send air to the respective rooms are selected from the blast air volume determined by the blast air volume determining step, the air conditioning system further has the air-conditioning ability determined by the air-conditioning ability determining step, and the air conditioner capable of setting an air-conditioning air volume which is equal to or less than the optimal air-conditioning air volume determined by the air-conditioning air volume determining step is selected. It is possible to optimally select the blower and the air conditioner.

According to a design method of an air conditioning system of a ninth aspect of the invention, when the air conditioner having the air-conditioning ability determined by the air-conditioning ability determining step cannot set the air-conditioning air volume which is equal to or less than the optimal air-conditioning air volume determined by the air-conditioning air volume determining step, the blower is selected such that a minimum air-conditioning air volume which can be set by the air conditioner becomes equal to or less than 70, of the total blast air volume. Especially when a total blast air volume required for the blower is small because a total volume of a room is small, it is possible to optimally design an air-conditioning air volume and a total blast air volume.

According to a design method of an air conditioning system of a tenth aspect of the invention, the blower having air volume adjustment means capable of adjusting an air volume is selected. After the air conditioning system is constructed, it is possible to increase or decrease an air volume using the air volume adjustment means, and to adjust the air-conditioning ability in accordance with variation in the air conditioning load of the respective rooms.

Embodiments of the present invention will be described hereinafter with reference to the drawings.

First Embodiment

FIG. 1 is a plan view of a first floor of a building showing a configuration of an air conditioning system according to a first embodiment of the present invention, and FIG. 2 is a plan view of a second floor of the building.

As shown in FIG. 1, an entrance 2, a living room 3, and a kitchen 4 are disposed and, a rest room 5, a bathroom 6, an undressing room 7 and the like are provided on the first floor of the building 1. The living room 3 is provided with stairs 8 to a second floor. A first floor ceiling of the building 1 is provided with spout grills (air intake sections) 9*a*, 9*b*, 9*c*, 9*d* for sending air into rooms on the first floor. One ends of first floor air ducts 10*a*, 10*b*, 10*c*, 10*d* are respectively connected to the spout grills 9*a*, 9*b*, 9*c*, 9*d*. The other ends of the first floor air ducts 10*a*, 10*b*, 10*c*, 10*d* are placed on the second floor. The spout grills 9*a*, 9*b*, 9*c*, 9*d* may be provided on a floor instead of the ceiling. When the spout grills 9*a*, 9*b*, 9*c*, 9*d* are provided on the floor, the first floor air ducts 10*a*, 10*b*, 10*c*, 10*d* are provided under the floor.

As shown in FIG. 2, a stair case 12 composed of a corridor 11 and the stairs 8 leading from the first floor is disposed on the second floor of the building 1. A room A13, a room B14 and a room C15 on the second floor of the building 1 are disposed next to the stair case 12. A closet A16 is provided in the room A13. A closet B17 is provided in the room B14. Spout grills (air intake sections) 18*a*, 18*b*, 18*c*, 18*d* which send wind into the rooms on the second floor are provided in a ceiling 62 on the second floor of the building 1. The spout grills (air intake sections) 18*a*, 18*b* are provided in the ceiling 62 of the room A13 on the second floor. The (air intake section) 18*c* is provided in the ceiling 62 of the room B14 on the second floor. The spout grill (air intake section) 18*d* is provided in the ceiling 62 of the room C15 on the second floor.

One ends of second floor air ducts 19*a*, 19*b*, 19*c*, 19*d* are respectively connected to the spout grills (air intake sections) 18*a*, 18*b*, 18*c*, 18*d*. The spout grills (air intake sections) 18*a*, 18*b*, 18*c*, 18*d* may be provided in the floor instead of the ceiling 62. When the spout grills (air intake sections) 18*a*, 18*b*, 18*c*, 18*d* are provided in the floor, the second floor air ducts 19*a*, 19*b*, 19*c*, 19*d* are disposed under the floor of the second floor.

FIG. 3 is an enlarged plan view of a stair case portion of the second floor of the building of the air conditioning system according to the first embodiment, FIG. 4 is a sectional view taken along a line A-A in FIG. 3, and FIG. 5 is a sectional view taken along a line B-B in FIG. 3.

As shown in FIGS. 3 to 5, the stair case 12 is surrounded by a side wall 20 of the stairs 8, a wall A21 reached when proceeding up the stairs 8 from the first floor, a partition wall 22 existing between the rooms A13, B14, C15 on the second floor, and a wall B23 which is opposed to the wall A21. A distance between the wall A21 and the wall B23 is about 3.8 m, and a width between the stairs 8 and the corridor 11 is about 0.9 m. Since a center size of a pillar in an architectural design drawing is used and a size in which a thickness of a wall is not taken into account is described, "about" is added to the sizes. This rule is applied also to the following size descriptions.

A handrail 24 is mounted on the corridor 11 on the side of the stairs 8. The handrail 24 is composed of a horizontal crosspiece 25 and vertical crosspieces 26. Slits 27 exist between the vertical crosspieces 26. A similar handrail 28 is mounted on the stairs 8 on the side of a space of the first floor.

An air conditioner 30*a* is placed on an upper side of the wall B23 of the stair case 12 close to the side wall 20. This air conditioner 30*a* is a wall-mounted indoor unit of a separate-type air conditioner which is connected to an outdoor unit (not shown). This air conditioner 30*a* has a function to set a blast air volume of the indoor unit as an air-conditioning air volume like strong wind, intermediate wind and weak wind. A suction port through which intake air current 32*a* is sucked is provided in an upper surface 31 of the air conditioner 30*a*. A spout port through which spout air current 33*a* is spouted is provided in a lower portion of a front surface of the air conditioner 30*a*. The spout port is provided with a vertical wind direction control plate 34. The vertical wind direction control plate 34 is set such that this spouts spout air current 33*a* substantially in a horizontal direction. Here, the expression "substantially in a horizontal direction" includes a downward direction within 15' from the horizontal direction. The spout port is provided with a horizontal wind direction control plate (not shown). The horizontal wind direction control plate is set such that this spouts spout air current 33*a* toward the wall A21 substantially parallel to the side wall 20.

First floor blowers 40*a*, 40*b*, 40*c*, 40*d* and second floor blowers 41*a*, 41*b*, 41*c*, 41*d* are mounted on the wall B23. The first floor blowers 40*a*, 40*b*, 40*c*, 40*d* and the second floor blowers 41*a*, 41*b*, 41*c*, 41*d* are disposed below the air conditioner 30*a*. The four first floor blowers 40 are provided, and the four second floor blower 41 are provided. One of the first floor air ducts 10 is connected to one of the first floor blowers 40, and one of the second floor air ducts 19 is connected to one of the second floor blowers 41.

Sirocco fans 42 are provided in the first floor blowers 40 and the second floor blowers 41. Air is sucked from the stair case 12, the sucked air flows through the first floor air ducts 10 and the second floor air ducts 19, and is spouted into the rooms in the building 1. If air is sucked from the stair case 12, intake air current 43 is generated. The sucked air flows through the first floor air ducts 10 and the second floor air ducts 19 as spout air current 44.

The first floor blowers 40*a*, 40*b*, 40*c*, 40*d* and the second floor blowers 41*a*, 41*b*, 41*c*, 41*d* include air volume adjustment means. The air volume adjustment means is a notch switch which changes the number of rotations of a fan for example or a shutter (not shown) which adjusts an opening area of each of the suction ports of the spout grills 9*a* to 9*d*.

Each of the rooms A13, B14, C15 on the second floor is provided with a lower clearance 51 of a door 50 which is an entrance from the stair case 12, and exhaust sections 52 located close to a ceiling 62 which is higher than the air conditioner 30*a* of the partition wall 22. Exhausted air current 53 of the second floor is formed in the lower clearance 51 and the exhaust sections 52. An opening which is in communication with the stair case 12 is provided in each of the rooms one the first floor. This opening corresponds to a discharge section 55 to the stair case 12, and exhausted air current 56 of the first floor is formed in this opening.

Hence, the stair case 12 becomes a return compartment where air groups discharged from the plurality of rooms in the building 1 which is composed of the living room 3, the kitchen 4, a room A13, a room B14 and a room C15 merge with each other. That is, the stair case 12 which becomes the return compartment is adjacent to the living room 3, the kitchen 4, the room A13, the room B14 and the room C15.

Blast air volumes of air which is sent to the living room 3, the kitchen 4, the room A13, the room B14 and the room C15 are determined by volumes of the living room 3, the kitchen 4, the room A13, the room B14 and the room C15 (blast air volume determining step). A total blast air volume (total blast air volume is called Vh hereinafter) which is total of the blast air volumes to the living room 3, the kitchen 4, the room A13, the room B14 and the room C15 determined in the blast air volume determining step is calculated (total blast air volume calculating step). Air-blowing ability and the number of blowers which send air to the living room 3, the kitchen 4, the room A13, the room B14 and the room C15 are selected from the blast air volumes determined by the blast air volume determining step. In this embodiment, the blast duct composes a portion of the blower. That is, the blast air volume used for selecting the blower is a blast air volume of air which is spouted from the spout grill (air intake section) through the blast duct. The blast air volume which is required for conditioning air is preferably at least 13 $m^3$/h or more per 2.5 $m^3$ of the room and ideally, about 20 $m^3$/h, and the blast air volume is adjusted in accordance with a size and a load of the room. In this embodiment, since the room A13 is larger than the room B14, the two spout grills 18*a*, 18*b* are provided, and air is sent by the blowers 41*a*, 41*b*. Since the blower is provided with blast adjustment means, usability becomes more excellent if one or more blowers are provided in one room.

The air-conditioning ability of the air conditioner 30*a* is determined by air conditioner load calculation concerning the building 1 (air-conditioning ability determining step).

That is, the air conditioning load is calculated based on transferred heat which enters from the wall, the window, the ceiling and the like, radiant heat of solar radiation which penetrates a window glass, heat and moisture generated from a person existing in the room, heat generated from illumination and a machine tool, and heat quantity and moisture generated from air taken from outside and draft as the air conditioning load (Haruo YAMADA, "Freezing and air conditioning", Japan, Kabushiki Kaisha Yokendo, Mar. 20, 1975, pages 240 to 247). More room is given to this load calculation result, the air conditioner 30*a* of the entire building 1 is selected from air conditioners which are lineup in terms of ability, and the entire building 1 is air-conditioned.

An optimal air-conditioning air volume (optimal air-conditioning air volume is called Vq hereinafter) of the air conditioner 30*a* is determined from the total blast air volume Vh calculated in the total blast air volume calculating step (air-conditioning air volume determining step).

The optimal air-conditioning air volume Vq is an air volume of 50% or less of the total blast air volume Vh, and is 70% or less at the most, and is an air volume where the air conditioner 30*a* can exhibit ability in accordance with the air conditioning load.

The air conditioner 30*a* includes air-conditioning ability which is determined by the air-conditioning ability determining step, and a model of the air conditioner 30*a* which can set an air-conditioning air volume which is equal to or less than the optimal air-conditioning air volume Vq determined by the air-conditioning air volume determining step is selected.

If a total volume of a room where air therein is to be conditioned is small, a minimum air-conditioning air volume which can be set by the air conditioner 30*a* may be larger, in some cases, than the optimal air-conditioning air volume Vq which is determined by the air-conditioning air volume determining step. In this case, the total blast air volume Vh of the blower is increased so that an air volume which is equal to or less than 70% of the total blast air volume Vh can be set by the air conditioner 30*a*.

That is, in order to maintain the air-conditioning ability of the air conditioner 30*a*, the air-conditioning air volume of the air conditioner 30*a* is not decreased more than necessary, and the blast air volume into the building 1 is increased to a value which is equal to or larger than 20 $m^3$/h per 2.5 $m^3$ of the room so that the minimum blast air volume which can be set by the air conditioner 30*a* becomes equal to or less than 50% of the total blast air volume Vh.

The method of increasing the blast air volume into the building is not limited to the increasing method of the blast air volume into the respective rooms, and it is also effective to send air also to a space under floor and an attic space where airproof and heat insulating properties against outside of the room are secured, and to provide an opening between the under floor space and the attic space and the return compartment to circulate conditioned air. Since the air conditioning load of the building itself is not varied even if the number of ventilation locations in the building and the blast air volume of the blower are too much, the above method does not affect the air-conditioning ability almost at all.

In this embodiment, a floor area of the building 1 is about 97.7 $m^2$, a height of the ceiling is 2.5 m, the air conditioner 30*a* having cooling ability corresponding to 4 kW is installed, and air of 700 $m^3$ is sent per hour at the time of cooling operation by cross flow fan in a weak wind mode. In each of the first floor blowers 40 and the second floor blowers 41, a blast air volume 2 per one blower is set to about 150 $m^3$/h in an intermediate notch. The total blast air volume Vh which is sent into the building 1 in this embodiment is about 1200 $m^3$/h, and this is larger than the air-conditioning air volume of the air conditioner 30*a*. That is, in this embodiment, an air volume of 58% of the total blast air volume Vh is designed as an air-conditioning air volume (weak wind mode) which can be set in the air conditioner 30*a*. Although it is not explained in this embodiment, if air supply to a space under floor at about 300 $m^3$/h is added for example, the total blast air volume Vh becomes about 1500 $m^3$/h. Therefore, an air-conditioning air volume 700 $m^3$/h of the air conditioner 30*a* is decreased to 46% of the total blast air volume Vh.

In the above-described configuration, if the air conditioner 30*a* is operated while setting the temperature in the building 1, temperature of the intake air current 32*a* is detected and the operation of the air conditioner of a cooling or heating operation is carried out. The conditioned air becomes spout air current 33*a* of the air conditioner 30*a*, and the air is spouted toward the wall A21 substantially parallel to the side wall 20. If the first floor blower 40 and the second floor blower 41 are operated, intake air current 43 and spout air current 44 of the blowers are generated.

As compared with wind speed of 3 to 5 m/s of spout air current 33*a* of the air conditioner 30*a*, wind speed of intake air current 43 of the blower (ventilation fan) is about 0.4 m/s, and the intake air current 43 of the blower (ventilation fan) is slower than the wind speed of the spout air current 33*a* of the air conditioner 30*a*. Further, since the spout air current 33*a* of the air conditioner 30*a* is sent by the cross flow fan, the current easily reaches a far location, and the spout air current 33*a* is less prone to be sucked by the intake air current 43 of the blower which is generated when surrounding air is sucked by the operation of the sirocco fan 42. Therefore, most portion of the spout air current 33*a* of the air conditioner 30*a* reaches a location near the wall A21 while being diffused, the spout air current 33*a* is reversed and returns toward the wall B23 along the stairs 8, and the spout air current 33*a* merges and mixed with the intake air current 43 of the blower having a large blast air volume. Hence, if the suction ports of the first floor blower 40 and the second floor blower 41 are provided while avoiding the spout direction of the spout air current 33*a* from the air conditioner 30*a*, air-conditioned circulation current 45 which is substantially circulated in the stair case 12 and diffused is formed, and short circuit is less prone to be generated.

Specific gravity of the spout air current 33*a* in the heating operation is lighter than that in the cooling operation and the spout air current 33*a* easily rise. Therefore, it is preferable that a direction of the spout air current 33*a* at the time of the heating operation is set to a downward direction more than a direction of the spout air current 33*a* at the time of the cooling operation so that the spout air current 33*a* is sent substantially in the horizontal direction.

If air is sent to the plurality of rooms of the building 1, a portion of the air from the rooms A13, B14, C15 on the second floor returns to the stair case 12 as exhausted air current 53 on the second floor and as exhausted air current 56 on the first floor from the rooms on the first floor. At this time, since the exhaust sections 52 open in the vicinity of the ceiling 62, most portion of the exhausted air current 53 on the second floor forms air-conditioned returning current 57 which flows toward the air conditioner 30*a* along the ceiling 62, and the most portion merges with the intake air current 32*a* of the air conditioner 30*a*. Hence, the air conditioner 30*a* detects air temperature which is close to temperature in the rooms and the operation of the air conditioner 30*a* is controlled. A place where the exhaust sections 52 are provided is not limited only if it is electrically conducted with the stair case 12, but if the exhaust sections 52 are provided close to the ceiling 62 of the stair case 12 and close to the air conditioner 30*a*, exhausted air current 53 is sucked into the larger number of air conditioners 30*a*, and temperature of the intake air current 32*a* becomes close to room temperature. Therefore, a difference between set temperature when the air conditioner 30*a* is operated and actual temperature in the building 1 becomes smaller, and the operation of the air conditioners is controlled.

The air-conditioned circulation current 45 flows such that it is opposed to the exhausted air current 53 and the intake air current 43 until the current 45 is reversed, and the current 45 involves surrounding air and is diffused. Therefore, as the air-conditioned circulation current 45 flows, temperature of the current 45 becomes higher than that of the spout air current 33*a* of the air conditioner 30*a* at the time of the cooling operation, and becomes lower than that of the spout air current 33*a* at the time of the heating operation.

The air-conditioned circulation current 45 is formed in the stair case 12 mainly on the side of the stairs 8, and the air-conditioned returning current 57 is formed in the stair case 12 mainly on the side of the corridor 11 on the second floor. Since the blast air volume sent to the rooms of the building 1 is larger than the air-conditioning air volume, spout air current 33*a* of the air conditioner 30*a*, the exhausted air current 56 on the first floor and the exhausted air current 53 on the second floor are mixed with each other in the stair case 12. If the current groups are mixed with each other, a difference between temperature of the air-conditioned circulation current 45 and temperature of the rooms further becomes smaller.

Air flows through the slit 27 of the handrail 24 or the handrail 28 and helps this mixing. A portion of the exhausted air current 56 on the first floor merges also with the air-conditioned returning current 57 from a boundary between the stairs 8 and the corridor 11. A ventilation slit (not shown) which brings the first floor and the second floor of the building 1 into conduction with each other may be provided in the corridor 11 so that current from the first floor easily merges.

In the air conditioning system of this embodiment, a difference between temperature of the spout air current 44 which is spouted to the rooms and temperature of the rooms is smaller than a difference between temperature of the spout air current 33*a* of the air conditioner 30*a* and temperature of the rooms. Therefore, persons existing in the rooms feel less stress caused by the difference between the temperature of the spout air current 44 and the temperature of the rooms, and comfortableness is enhanced.

In the case of an air conditioner which controls the number of rotations of a compressor by an inverter, the air conditioner is operated such that when a blast air volume in a room is constant, a difference between spout temperature and room temperature when an air conditioning load is small becomes small. Hence, when a compressor of the air conditioner 30*a* is of the inverter type, comfortableness is not deteriorated even if a blast air volume to the room is decreased when the air conditioning load is small such as an intermediate season other than summer and winter. Therefore, there is no problem even if the total blast air volume Vh is decreased and the air-conditioning air volume becomes 70% or more of the total blast air volume Vh.

All of the air conditioner 30*a*, the first floor blowers 40 and the second floor blowers 41 may not be placed on the wall B23. One or some of the blowers may be provided in the stair case 12 of the first floor portion or may be provided on the partition wall 22. A direction of the spout air current 33*a* may be adjusted by a horizontal wind direction control plate of the air conditioner 30*a*, air-conditioned circulation current 45 which merges with intake air current 43 of the blower can be formed, a wind passage of air-conditioned returning current 57 may be formed in a space other than a space in which the air-conditioned circulation current 45 is formed, and the air conditioner 30*a* may be provided on the partition wall 22. It is only necessary that air-conditioned circulation current 45 is formed in a longitudinal direction of a return compartment which is rectangular in shape as viewed from above.

The air conditioner 30*a* may be provided on each of the wall B23 and the partition wall 22, and it is possible to provide a heat source at the time of the heating operation such as a hot water radiator other than the air conditioner 30*a*. It is only necessary that spout air current groups from two machines merge with each other and circulate in the stair case 12, and the current groups are sucked into the first floor blowers 40 and the second floor blowers 41. Therefore, the present design and construction method can be applied also to a developed air conditioning system in which hot water is generated by solar heat for example and this is used as a heat source.

In the air conditioning system of the first embodiment, the total blast air volume Vh to the rooms is larger than the air-conditioning air volume. Therefore, a portion of air which returns to the return compartment from the rooms is sucked into the air conditioner 30*a*, and remaining air is sufficiently mixed with spouted air of the air conditioner 30*a*, and the air is conditioned and returned to the respective rooms.

If the blast air volume is adjusted by the air volume adjustment means of the blowers, each of the blowers can cope with variation of the air conditioning load of the rooms.

Capacity of the stair case 12 is about 16.2 $m^3$, and the air conditioner 30*a* forms the air-conditioned circulation current 45 to perform the air conditioning. Therefore, it is unnecessary to provide an air conditioner chamber for exclusive use. If the air-conditioned circulation current 45 is formed, the capacity of the return compartment may be less than this, but capacity of a general stair case is sufficient as capacity of the return compartment, and it is easy to compose the air conditioner 30*a*, the first floor blowers 40, the second floor blowers 41, the exhaust sections 52 and the discharge section 55.

Second Embodiment

FIG. 6 is a plan view of a building showing a configuration of an air conditioning system according to a second embodiment of the present invention, and FIG. 7 is a sectional view of a corridor portion of the building taken along a line C-C.

As shown in FIGS. 6 and 7, a building 61 is a one-story house having an entrance 2. A living room 3 and a kitchen 4 are disposed, and a rest room 5, a bathroom 6 and an undressing room 7 are provided. A room A63 and a room B64 are disposed in the building 61. A closet A65 is provided in the room A63. The room A63, the room B64 and the living room 3 of the building 61 are connected to each other through a corridor 66.

A ceiling 62 or a floor 63 of each of the room A63 and the room B64 is provided with spout grills (air intake sections) 68*a*, 68*b*, 68*c*, 68*d*, 68*e*, 68*f* which send wind into the rooms. One ends of the air ducts 63*a*, 63*b*, 64*c*, 64*d*, 64*e*, 63*f* are respectively connected to the spout grills 68*a*, 68*b*, 68*c*, 68*d*, 68*e*, 68*f*. The air ducts 63*a*, 63*b*, 63*f* are disposed in the ceiling 62 as ceiling air ducts 82, and the air ducts 64*c*, 64*d*, 64*e* are disposed under floor as underfloor air ducts 83.

The corridor 66 is a space surrounded by the ceiling 62, the floor 63, an entrance wall 71 on which the entrance door 70 is mounted, a partition wall A72 with respect to the living room 3, a partition wall B73 with respect to the kitchen 4, a partition wall C74 with respect to the rest room 5, a wall D75 on which the air conditioner 30*b* is mounted, a partition wall E76 with respect to the room A63, and a partition wall F77 with respect to the room B64.

The air conditioner 30*b* is disposed above the wall D75 of the corridor 66 at a location close to the partition wall E76. This air conditioner 30*b* is a wall-mounted indoor unit of a separate-type air conditioner which is connected to an outdoor unit (not shown). A suction port through which intake air current 32*a* is sucked is provided in an upper surface of the air conditioner 30*b*. A spout port from which spout air current 33*b* is spouted is provided in a lower portion of a front surface of the air conditioner 30*b*. The spout port is provided with a vertical wind direction control plate 34. The vertical wind direction control plate 34 is set such that it spouts the spout air current 33*b* substantially in the horizontal direction. The spout port is provided with a horizontal wind direction control plate (not shown). The horizontal wind direction control plate is set such that it spouts the spout air current 33*b* toward the entrance wall 71 which is substantially parallel to the partition wall E76.

Three ceiling blowers 80 and three underfloor blowers 81 are disposed below the air conditioner 30*b*. One ceiling air duct 82 is connected to one of the ceiling blowers 80, and one underfloor air duct 83 is connected to one of the underfloor blowers 81. Sirocco fans (not shown) are provided in the ceiling blower 80 and the underfloor blower 81, air is sucked from the corridor 66, the sucked air flows through a ceiling air duct 82 and an underfloor air duct 83, and is spouted into the room A63, the room B64, the living room 3 and the kitchen 4 in the building 61. If air is sucked from the corridor 66, intake air current 43 is generated. The sucked air flows through the ceiling air ducts 82 and the underfloor air ducts 83 as spout air current 44.

The ceiling blower 80 and the underfloor blower 81 include air volume adjustment means. The air volume adjustment means is a notch switch which changes the number of rotations of a fan for example or a shutter (not shown) which adjusts an opening area of each of the suction ports of the spout grills 68*a* to 68*f*.

The ceiling blower 80 and the underfloor blower 81 are provided on a partition wall G84 which is parallel to the wall D75. That is, a space between the wall D75 and the partition wall G84 is a wind-sending compartment 85, and a wind-sending opening 86 which is in communication with the wind-sending compartment 85 from the corridor 66 is formed below the wall D75. This wind-sending opening 86 substantially corresponds to an air suction section from the corridor 66 of the ceiling blower 80 and the underfloor blower 81. Therefore, according to this configuration, it is unnecessary to provide the ceiling blower 80 and the underfloor blower 81 below the air conditioner 30*b*. A sound absorbing material is provided in an inner wall of the wind-sending compartment 85.

Exhaust sections 52 are provided in the vicinity of the ceiling 62 which is higher than the air conditioner 30*b* of the partition wall E76 and the partition wall F77, and lower clearances 88 of doors 87 which are entrances to the room A63 and the room B64 from the corridor 66 are also provided. Exhausted air current 89 is formed in the lower clearances 88 and the exhaust sections 52. An opening which is in communication with the living room 3 corresponds to an discharge section 90 to the corridor 66, and exhausted air current 91 from the living room 3 is formed in this opening.

Hence, the corridor 66 becomes a return compartment where air groups discharged from the plurality of rooms, i.e., the living room 3, the kitchen 4, the room A63 and the room B64 merge with each other. The corridor 66 which becomes the return compartment is adjacent to the living room 3, the kitchen 4, the room A63 and the room B64.

Blast air volumes of air sent to the living room 3, the kitchen 4, the room A63 and the room B64 are determined from capacity of the living room 3, the kitchen 4, the room A63 and the room B64 (blast air volume determining step). Then, a total blast air volume Vh in which the blast air volumes of the air sent to the living room 3, the kitchen 4, the room A63 and the room B64 determined by the blast air volume determining step are added up is calculated (total blast air volume calculating step). From the blast air volume determined by the blast air volume determining step, air-blowing ability and the number of the blowers which send wind to the living room 3, the kitchen 4, the room A63 and the room B64 are selected. In the second embodiment, the blast duct composes a portion of the blower. That is, the blast air volume used for selecting the blowers is a blast air volume which is spouted from the spout grills (air intake sections) through the ducts. The blast air volume which is required for conditioning air is preferably at least 13 $m^3$/h or more per 2.5 $m^3$ of the room and ideally, about 20 $m^3$/h, and the blast air volume is adjusted in accordance with a size and a load of the room. When the room is large, two or more blowers are placed, i.e., the spout grills are provided at two or more locations in some cases.

The air-conditioning ability of the air conditioner 30*b* is determined by air conditioning load calculation concerning the building 61 (air-conditioning ability determining step).

The optimal air-conditioning air volume Vq of the air conditioner 30*b* is determined from the total blast air volume Vh calculated by the total blast air volume calculating step (air-conditioning air volume determining step).

The air conditioner 30*b* has air-conditioning ability determined by the air-conditioning ability determining step, a model of the air conditioner 30*b* is selected such that it can set the air-conditioning air volume which is equal to or less than the optimal air-conditioning air volume Vq determined by the air-conditioning air volume determining step.

If a total volume of a room where air therein is to be conditioned is small, a minimum air-conditioning air volume which can be set by the air conditioner 30*b* may be larger, in some cases, than the optimal air-conditioning air volume Vq which is determined by the air-conditioning air volume determining step. In this case, the total blast air volume Vh of the blower is increased so that an air volume which is equal to or less than 70% of the total blast air volume Vh can be set by the air conditioner 30*b*.

That is, in order to maintain the air-conditioning ability of the air conditioner 30*b*, the air-conditioning air volume of the air conditioner 30*b* is not decreased more than necessary, and the blast air volume into the building 61 is increased to a value which is equal to or larger than 20 $m^3$/h per 2.5 $m^3$ of the room so that the minimum blast air volume which can be set by the air conditioner 30*b* becomes equal to or less than 50, of the total blast air volume Vh. Even if the blast air volume of the blower is excessively large, this does not affect the air-conditioning ability.

In the super airtight and highly heat-insulated residential house of this embodiment, a floor area of the building 61 is about 79.3 $m^2$, a height of the ceiling is 2.5 m, the air conditioner 30*b* having cooling ability corresponding to 3.6 kW is installed, and air of 510 $m^3$ is sent per hour at the time of cooling operation by cross flow fan in a weak wind mode. In each of the ceiling blower 80 and the underfloor blower 81 which send wind to the rooms, a blast air volume per one blower is set to about 150 $m^3$/h in an intermediate notch. The total blast air volume Vh which is sent into the building 61 in this embodiment is about 900 $m^3$/h, and this is larger than the air-conditioning air volume of the air conditioner 30*b*.

That is, in this embodiment, an air volume of 57% of the total blast air volume Vh is designed as an air-conditioning air volume (weak wind mode) which can be set in the air conditioner 30*b*.

In the above-described configuration, if the air conditioner 30*b* is operated while setting the air conditioning temperature in the air conditioner 30*b*, temperature of the intake air current 32*a* is detected and the operation of the air conditioner of cooling or heating operation is carried out. The conditioned air becomes spout air current 33*b* of the air conditioner 30*b*, and the air is spouted toward the entrance wall 71 substantially parallel to the partition wall E76. The ceiling blower 80 and the underfloor blower 81 are operated, and intake air current 43 and spout air current 44 of the blowers are generated.

In this embodiment, the ceiling blower 80 and the underfloor blower 81 are disposed on the back of the wind-sending compartment 85, and the wind-sending compartment 85 is provided with the sound absorbing material. Therefore, operation noise of the ceiling blower 80 and the underfloor blower 81 is less prone to leak toward the corridor 66. The air ducts 63*a*, 63*b*, 63*f* and the air ducts 64*c*, 64*d*, 64*e* also use sound absorbing ducts.

As compared with wind speed of 3 to 5 m/s of spout air current 33*b* of the air conditioner 30*b*, wind speed of intake air current 43 of the blower (ventilation fan) is about 0.4 m/s, and the intake air current 43 of the blower (ventilation fan) is slower than the wind speed of the spout air current 33*b* of the air conditioner 30*b*.

Therefore, most portion of the spout air current 33*b* of the air conditioner 30*b* reaches a location near the entrance wall 71, the spout air current 33*b* is reversed and returns toward the wall D75 along the floor 63, and the spout air current 33*b* merges with the intake air current 43 of the blower. Hence, if the wind-sending opening 86 is provided while avoiding the spout direction of the spout air current 33*b* from the air conditioner 30*b*, air-conditioned circulation current 92 is formed in the corridor 66, and short circuit is less prone to be generated.

Depending upon a distance between the air conditioner 30*b* and the entrance wall 71, and also depending upon the setting of the air-conditioning air volume of the air conditioner 30*b*, the following phenomenon may be generated. That is, most of the spout air current 33*b* does not reach the entrance wall 71 and is diffused, the spout air current 33*b* merges with the intake air current 43 of the blower, and air-conditioned circulation current 92 is formed.

If wind is sent to the room A63, the room B64, the living room 3 and the kitchen 4 of the building 61, the wind returns to the corridor 66 as exhausted air current 89 and exhausted air current 91. At this time, since the exhaust sections 52 open in the vicinity of the ceiling 62, most of the exhausted air current 89 forms air-conditioned returning current 93 which flows toward the air conditioner 30*b* along the ceiling 62, and the most of the exhausted air current 89 merges with the intake air current 32*a* of the air conditioner 30*b*. A portion of the air-conditioned returning current 93 is formed also by exhausted air current 91 which flows in the vicinity of the ceiling 62 from the living room 3. The air conditioner 30*b* detects air temperature close to temperature of the room A63, the room B64 and the living room 3, and operation of the air conditioner 30*b* is controlled.

Until the air-conditioned circulation current 92 is reversed, the current 92 flows such that it is opposed to the exhausted air current 89 and the air-conditioned returning current 93, the current 92 involves the surrounding air and is diffused. Therefore, as a flowing distance becomes longer, temperature of the air-conditioned circulation current 92 becomes higher than that of the spout air current 33*b* of the air conditioner 30*b* at the time of cooling operation, and becomes lower than temperature of the spout air current 33*b* at the time of the heating operation.

By the mixing between the spout air current 33*b* of the air conditioner 30*b* and surrounding air, a difference between temperature of spout air current 44 which is spouted to the room A63, the room B64 and the living room 3 and room temperature of the room A63, the room B64 and the living room 3 becomes smaller than a difference between temperature of the spout air current 33*b* of the air conditioner 30*b* and room temperature of the room A63, the room B64 and the living room 3. Therefore, persons existing in the rooms feel less stress caused by the difference between the temperature of the spout air current 44 and the temperature of the rooms, and comfortableness is enhanced.

Further, when the persons open the entrance door 70 from outside of the building 61 and enter the rooms, they touch the air-conditioned circulation current 92 having temperature which is lower than that of the room A63, the room B64 and the living room 3 at the time of cooling operation, and which is higher than that of the room A63, the room B64 and the living room 3 at the time of heating operation. Therefore, hotness and coldness felt by the persons outside can be softened, and it is also possible to prevent outside air which enters from the entrance door 70 from directly entering the room A63, the room B64 and the living room 3.

Further, in a super airtight and highly heat-insulated residential house, a heat exchange ventilator is disposed for ventilation on a steady basis, but if the ceiling 62 of the entrance 2 is provided with an outdoor air spout port of the ventilator, air is mixed with air-conditioned circulation current 92 and is sent to the room A63 and the room B64. When the entrance door 70 is opened, outdoor air which is spouted from the heat exchange ventilator has high static pressure, and the air easily flows out from the rooms through the opening of the entrance door 70. Therefore, an amount of outside air which enters can further be reduced.

When the building is large, it is possible to divide the inside space of the building into zones, and to use a combination of the above-described first and second embodiments.

In both the first and second embodiments, moving spaces of people are utilized in the building. Since residents do not stay long in these spaces, machines can be disposed so that performance of the air conditioner and the blower can easily be exerted, and these spaces are places where operation noise of these machines is less prone to affect residents. Further, it is easy to store the blowers.

Further, the air conditioner 30*a* is disposed above the corridor 11 of the stair case 12, and air is spouted substantially in the horizontal direction. Therefore, spout air current 33*a* does not directly hit persons who go back and forth through the stair case 12.

INDUSTRIAL APPLICABILITY

It is possible to easily condition air in the entire room using a moving space of a resident such as a stair case and a corridor. Further, since an inside space of a building can be divided into a plurality of zones in accordance with ability of an air conditioner and air can be conditioned, the air conditioning system can also be applied to air conditioning of buildings such as commercial facilities and hospitals having large floor areas.

EXPLANATION OF SYMBOLS

1 building
12 stair case
9*a*, 9*b*, 9*c*, 9*d* spout grill (air intake section)
18*a*, 18*b*, 18*c*, 18*d* spout grill (air intake section)
30*a* air conditioner
33 spout air current of air conditioner
41*a*, 41*b*, 41*c*, 41*d* second floor blower
40*a*, 40*b*, 40*c*, 40*d* first floor blower
52 exhaust section
55 discharge section
61 building
66 corridor
68*a*, 68*b*, 68*c*, 68*d*, 68*e*, 68*f* spout grills
30*b* air conditioner
80 ceiling blower
81 underfloor blower
90 exhaust section

The invention claimed is:

1. An air conditioning system, wherein a return compartment which is adjacent to a plurality of rooms is formed in a building, said return compartment having a side wall, the rooms are provided with one or a plurality of air intake sections which spout air sent from blowers, an exhaust section which forms exhausted air current directed from the rooms toward the return compartment is provided between the rooms and the return compartment, at least one air conditioner is placed on an upper side of the side wall of the return compartment, spout air current of the air conditioner forms an air-conditioned circulation current in which a direction of the current is reversed in the return compartment, and the spout air current of the air conditioner is mixed with the exhausted air current from the rooms in the return compartment and is drawn into the blower.

2. The air conditioning system according to claim 1, wherein the spout air current of the air conditioner is reversed by a wall of the return compartment and forms the air-conditioned circulation current.

3. The air conditioning system according to claim 1, wherein the air conditioner is placed on the upper side of the one side wall which forms the return compartment, and a suction port of the blower is provided while avoiding a direction of the spout air current from the air conditioner.

4. The air conditioning system according to claim 1, wherein the air intake sections in the rooms comprise ducts, and a blast air volume is at least 13 $m^3$/h or more per 2.5 $m^3$.

5. The air conditioning system according to claim 1, wherein a total blast air volume to the rooms is larger than an air-conditioning air volume of the air conditioner.

* * * * *